United States Patent [19]

Chibana et al.

[11] 3,992,971

[45] Nov. 23, 1976

[54] ELECTRONIC MUSICAL INSTRUMENT

[75] Inventors: Masanobu Chibana; Tsuyoshi Futamase, both of Hamamatsu, Japan

[73] Assignee: Nippon Gakki Seizo Kabushiki Kaisha, Japan

[22] Filed: Nov. 11, 1975

[21] Appl. No.: 630,861

[30] Foreign Application Priority Data

Nov. 15, 1974 Japan ..... 49-131782

[52] U.S. Cl. ..... 84/1.11; 84/1.03; 84/1.19

[51] Int. Cl.[2] ..... G10F 1/00

[58] Field of Search ..... 84/1.01, 1.03, 1.11, 84/1.19, 1.22, 1.24, DIG. 4, 1.23

[56] References Cited

UNITED STATES PATENTS

| | | | |
|---|---|---|---|
| 3,809,786 | 5/1974 | Deutsch | 84/1.03 X |
| 3,809,788 | 5/1974 | Deutsch | 84/1.03 X |
| 3,809,790 | 5/1974 | Deutsch | 84/1.01 |
| 3,809,792 | 5/1974 | Deutsch | 84/1.24 |
| 3,910,150 | 10/1975 | Deutsch et al. | 84/1.04 |

*Primary Examiner*—Ulysses Weldon

*Attorney, Agent, or Firm*—Ladas, Parry, Von Gehr, Goldsmith & Deschamps

[57] ABSTRACT

An electronic musical instrument capable of producing a large number of harmonic contents with a small number of calculation circuits. A composite wave consisting of plural harmonics can be mathematically expressed as a multiplication of a factor including an order number of a harmonic and a factor or factors not including an order number of a harmonic. The instrument according to the invention utilizes this principle and produces a composite wave by first obtaining these two kinds of factors individually and thereafter multiplying them together.

An example of the invention capable of calculating four harmonics simultaneously and another example capable of calculating two harmonics simultaneously are described.

5 Claims, 2 Drawing Figures

ELECTRONIC MUSICAL INSTRUMENT

BACKGROUND OF THE INVENTION

This invention relates to an electronic musical instrument capable of producing information of a plurality of harmonics by a single calculation.

In a digital type electronic musical instrument as disclosed in U.S. Pat. No. 3,809,786, waveform values at respective sampling points of respective harmonics as expressed in Fourier series are obtained by individual calculation in real time for each harmonic. If the number of harmonics increases (i.e. harmonics of higher degree are included) in the prior art instrument, the number of calculation steps must also increases. Since the waveform value at the respective sample points must be calculated within a certain limited time, the increase in the number of calculations necessitates an increase in calculation speed or, if calculation speed is to remain unchanged, a large number of additional calculation devices must be provided. Increase in the calculation speed however, is limited due to technical and cost reasons. Provision of a large number of additional calculation devices results in a complicated and bulky construction and high manufacturing cost.

SUMMARY OF THE INVENTION

It is, therefore, an object of the present invention to provide an electronic musical instrument capable of producing composite wave including as many harmonics as possible at a time by a single calculation thereby obtaining many harmonic contents with a simple construction.

The basic principle of the invention will now be described.

Spectrum distribution of harmonics constituting a musical tone shows that levels (amplitude coefficients) of harmonics of adjacent harmonic orders resemble each other and this is particularly the case with harmonic contents of high harmonic orders. In view of this characteristic, if calculation of instantaneous wave values of a plurality of adjacent harmonics which are close in their level is conducted at a time to obtain a composite wave of these harmonics, level (amplitiude coefficient) information characterizing a tone color is produced by calculating an average level of these harmonic components, and this level information is multiplied with the composite waveform, the plural harmonic contents can be substantially calculated by a single calculation (i.e. in one unit calculation time).

The composite wave consisting of adjacent harmonics can be calculated, for example, by the following formula (1). This is a formula for simultaneously calculating two harmonics.

$$Ym_2 = \sin(n-1)\omega_0 t + \sin n\omega_0 t \qquad (1)$$

where $\omega_0$ represents the angular velocity of fundamental wave, $n$ a harmonic order, $t$ time and $Ym_2$ composite wave consisting of two harmonic components at time $t$.

This formula (1) can also be expressed by the following formula (2):

$$Ym_2 = 2 \sin (n - \tfrac{1}{2}) \omega_0 t \cdot \cos \tfrac{1}{2} \omega_0 t \qquad (2)$$

In this formula (2), the harmonic order $n$ is not included in the cosine wave function.

The formula (2) is transformed into the following logarithmically expressed formula (3):

$$\log Ym_2 = \log 2 + \log \sin(n - \tfrac{1}{2}) \omega_0 t + \log \cos \tfrac{1}{2} \omega_0 t \qquad (3)$$

In the formula (3), the multiplication factors in the formula (2) is substituted by addition terms and this contributes to simplification of construction of a calculation device in a digital type apparatus.

Four harmonics can be calculated simultaneously in a similar manner by the following formula (4).

$$Ym_4 = \sin(n-2)\omega_0 t + \sin(n-1)\omega_0 t + \sin n\,\omega_0 t + \sin(n+1)\,\omega_0 t \qquad (4)$$

where $Ym_4$ represents composite wave consisting of four harmonic components at time $t$.

This formula (4) can be transformed into the following formula (5)

$$Ym_4 = 2 \sin(n - 3/2)\,\omega_0 t \cdot \cos \tfrac{1}{2} \omega_0 t + 2 \sin(n + \tfrac{1}{2})\,\omega_0 t \cdot \cos \tfrac{1}{2} \omega_0 t = 4 \sin(n - \tfrac{1}{2})\,\omega_0 t \cdot \cos \omega_0 t \cdot \cos \tfrac{1}{2} \omega_0 t \qquad (5)$$

This formula is transformed into the following logarithmically expressed formula (6):

$$\log Ym_4 = \log 4 + \log \sin(n - \tfrac{1}{2})\,\omega_0 t + \log \cos \omega_0 t + \log \cos \tfrac{1}{2} \omega_0 t \qquad (6)$$

In the formula (6), only one term includes the harmonic order $n$. It will be noted from the above formulas that a composite wave consisting of plural harmonics can be mathematically analyzed into a term which includes the harmonic order $n$ and a term or terms which does not or do not include $n$. This signifies that provision of only one calculation unit (harmonic generator by accumulation) capable of obtaining information of the respective harmonics on the basis of the first information (e.g. by sequentially accumulating phase information of the fundamental wave) will suffice. If, for example, one calculation unit in the prior art instrument can conduct calculation 8 times at a certain calculation speed, eight harmonics are obtained by this calculation unit. According to the present invention, 36 harmonics can be obtained by using one calculation unit, assuming that four harmonics are calculated simultaneously and that the calculation unit can conduct calculation 8 times (accumulation) at the same calculation speed. In the calculation according to the invention the value of the harmonic order $n$ in each accumulation determines the number of harmonics to be calculated simultaneously. If, for example, the 18th – 21st harmonics are calculated simultaneously at the first calculation by selecting $n$ at 20, the next calculation is conducted for obtaining the 22nd – 25th harmonics simultaneously by selecting $n$ at 24. A preferred embodiment of the invention will now be described with reference to the accompanying drawings.

DETAILED DESCRIPTION OF A PREFERRED EMBODIMENT

Figure 1:
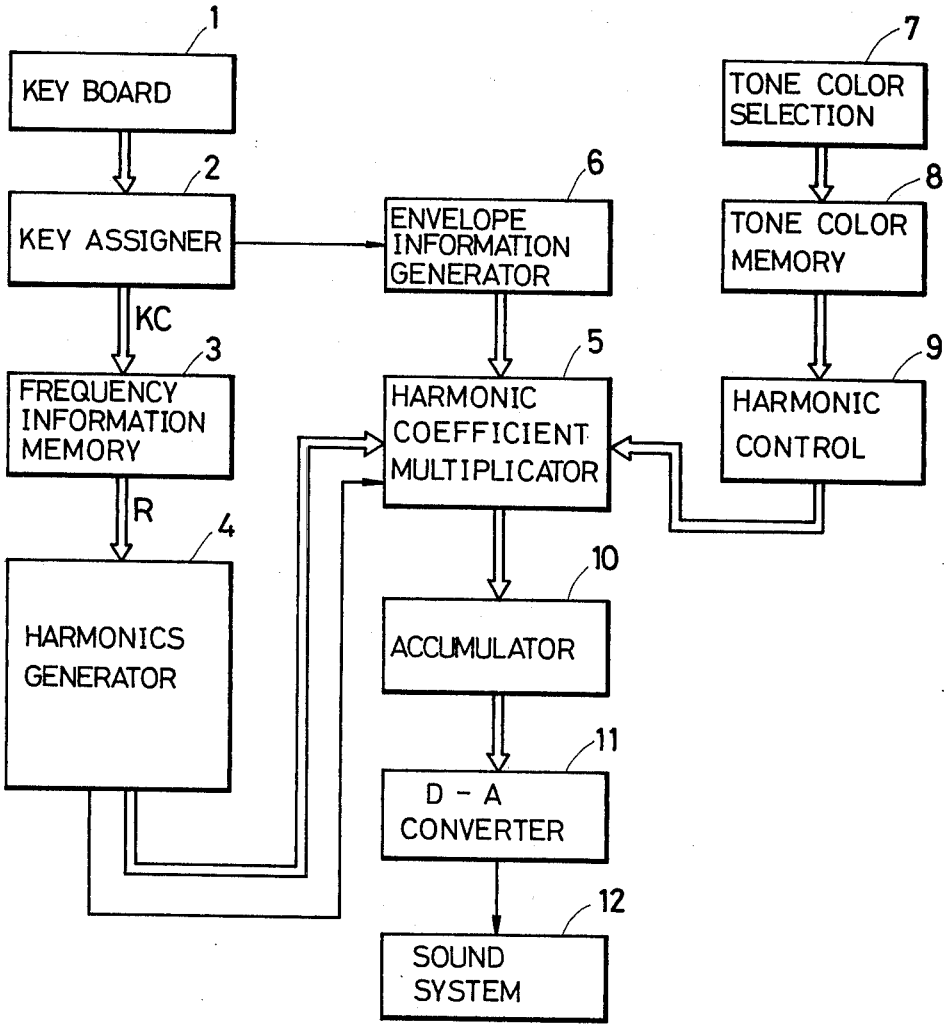
FIG. 1 is a block diagram schematically showing a preferred embodiment of the electronic musical instrument according to the invention.

FIG. 1 is block diagram schematically showing an entire construction of the electronic musical instrument according to the invention. The basic concept of the entire construction is to calculate waveform values of respective harmonics of a musical tone wave to be reproduced at respective sample points with a regular time interval, multiply the waveform values with amplitude coefficients of the respective harmonics characterizing the tone color of the musical tone and thereafter cumulatively add all the harmonic components to form the desired musical tone waveshape. This basic construction has already been described in a U.S. Pat. No. 3,809,786 so that detailed description of the entire construction will be omitted and a harmonic oscillator 4 which constitutes an important feature of the present invention will be described in detail.

A key assigner 2 produces key address codes KC representing the key names of depressed keys in response to key-on information supplied from a keyboard circuit 1. These key address codes KC are allotted in a time sharing manner to respective channels corresponding to a maximum number of tones to be produced simultaneously and are read out sequentially at each channel time.

The key assigner 2 also produces various clock pulses or time-sharing information used for controlling time-shared synchronized operation of respective units constituting the instrument. Assume, for example, that the inventive electronic musical instrument uses higher harmonics up to the eighth harmonic and that a maximum number of tones to be reproduced simultaneously is eight. Clock pulses are counted by a first counter of eight stages (not shown) to form time sharing time slots for each harmonics and the frequency divided output of this counter is further counted by a second counter of eight stages (not shown) to form time sharing time alots for each of channels corresponding in number to the maximum number of tones to be produced simultaneously. The output of the first counter is hereinafter referred to as a harmonic order signal BTC. This signal BTC is utilized for forming regular time interval of calculation required to produce the respective harmonic components as will be described later. The key assigner 2 provides the various units with signals representing key-on and key-off for producing various envelope signals.

A frequency information memory 3 previously stores frequency information R which is a value proportionate to the fundamental wave frequency of each note. Frequency information R corresponding to the depressed key is read out in response to contents of key address code KC.

A harmonic oscillator 4 calculates values of a plurality of harmonics at a time in accordance with the formula (3) or (6). This calculation is made in a time sharing manner by each group of plural harmonics. Calculation by the term containing the variable n is sequentially made by accumulation in eight times with a regular time interval corresponding to the harmonic order signal BTC. Some examples of such harmonic group consisting of plural harmonics composite wave values of which are obtained by a single calculation are shown in the following table.

Table

| | calculation timing (group) | harmonics order (n−2) | (n−1) | (n) | (n+1) |
|---|---|---|---|---|---|
| First example | $BTC_8$ | | 9 | 10 | |
| | $BTC_7$ | | 11 | 12 | |
| | $BTC_6$ | | 13 | 14 | |
| | $BTC_5$ | | 15 | 16 | |

Table -continued

| | calculation timing (group) | harmonics order (n−2) | (n−1) | (n) | (n+1) |
|---|---|---|---|---|---|
| | $BTC_4$ | 18 | 19 | 20 | 21 |
| | $BTC_3$ | 22 | 28 | 24 | 25 |
| | $BTC_2$ | 26 | 27 | 28 | 29 |
| | $BTC_1$ | 30 | 31 | 32 | 33 |
| Second example | $BTC_8$ | 34 | 35 | 36 | 37 |
| | $BTC_7$ | 38 | 39 | 40 | 41 |
| | $BTC_6$ | 42 | 43 | 44 | 45 |
| | $BTC_5$ | 46 | 47 | 48 | 49 |
| | $BTC_4$ | 50 | 51 | 52 | 53 |
| | $BTC_3$ | 54 | 55 | 56 | 57 |
| | $BTC_2$ | 58 | 59 | 60 | 61 |
| | $BTC_1$ | 62 | 63 | 64 | 65 |

The table shows harmonic groups each considering of two harmonics and harmonic groups each consisting of four harmonics. Calculation of the respective groups is conducted during eight states of the harmonic order signal BTC (i.e. $BTC_1$ – $BTC_8$). In the first example, simultaneous calculation of four harmonics in accordance with the formula (6) is conducted by each group during $BTC_1$ – $BTC_4$, and simultaneous calculation of two harmonics in accordance with the formula (3) is conducted by each group during $BTC_5$ – $BTC_8$. In the second example, simultaneous calculation of harmonic groups each consisting of four harmonics is conducted. The higher the harmonic order $n$ is, the smaller becomes difference in levels between harmonics of adjacent orders. This enables increase in the number of harmonics to be calculated simultaneously. For example, harmonic contents of high degrees such as 40th, 50th, 60th may be calculated by a group of eight.

Figure 2:
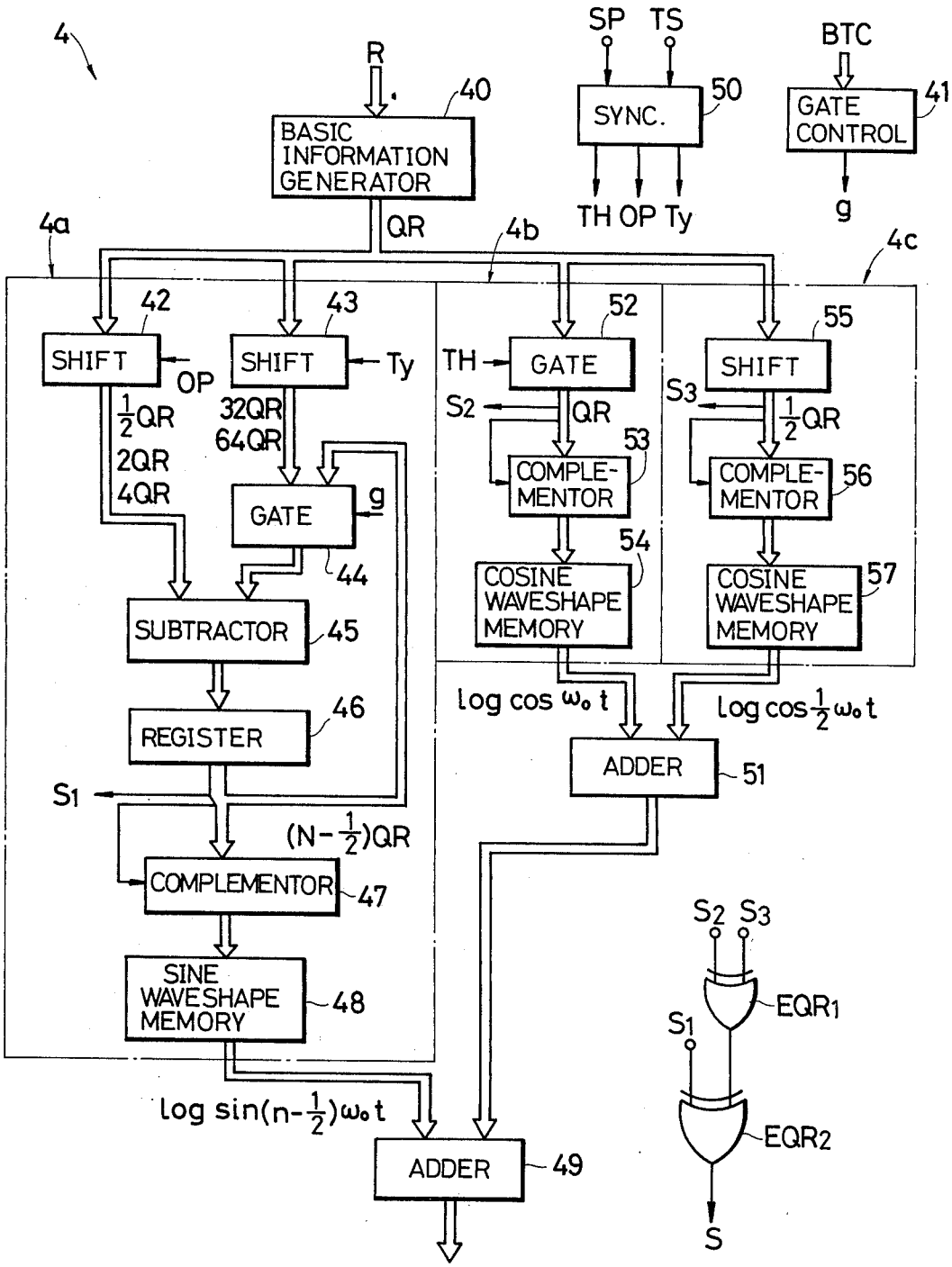
FIG. 2 is a block diagram showing an essential part of the embodiment.

FIG. 2 shows an example of the harmonic generator 4. This harmonic oscillator 4 is capable of switching between the first example and the second example of the table.

A basic information generator 40 cumulatively counts with a certain interval (e.g. every 8 channel times) frequency information R read out in a time shared manner from a frequency information memory 3 at each channel time thereby forming basic information QR($Q = 1, 2, 3 \ldots$) to be used for producing harmonic information. The phase of the fundamental wave is determined by this basic information. That is, the basic information QR corresponds to the phase angle $\omega_0 t$. The basic information QR is generated in time sharing with respect to the eight tones (i.e. at each channel time).

The output QR of the basic information generator 40 is applied to harmonic calculator **4*a* and cosine wave content generators 4*b*, 4*c*. The first harmonic calculator 4*a* performs calculation of the term containing the variable $n$ in the formula (3) or (6) (8 times in one channel time) to produce a value corresponding to the sine wave function component log sin $(n - ½)\ \omega_0 t$. The cosine wave component generator 4*b* is provided for producing the cosine wave function component log cos $\omega_0 t$ in the formula (6). The cosine wave component generator 4*c* for producing the cosine wave function component log cos ½ $\omega_0 t$. Values obtained by these generators 4*b* and 4*c*** do not change during one channel time.

According to the present embodiment, the harmonic calculator **4*a* conducts calculation from harmonic of a higher order. The calculation timing starts from $BTC_1$ and ends at $BTC_8$ as shown in the first example in the table. This calculation timing is formed with a regular time interval responsive to the signal BTC. More specifically, a gate control unit 41 generates, upon receipt of the signal BTC, a gate control pulse $g$ of an interval corresponding to each calculation time, and the calculation timing $BTC_1$ – $BTC_8$ if formed in accordance with this pulse $g$. In the case of the first example, calculation is first conducted wih the harmonic order $n$ at the timing $BTC_1$ being set at 32. As the calculation timing proceeds, numerical value 4 is subtracted from each preceeding order value, and, after the calculation timing has changed from $BTC_5$ to $BTC_6$, numeral 2 is now subtracted from each preceeding order value. In the case of the second example, calculation is first conducted with the harmonic order at the timing $BTC_1$ being set at 64. As calculation proceeds, 4 is subtracted from each preceeding order to produces information of the order $n$ at each calculation timing. As described in the foregoing, calculation element must be changed as the calculation timing proceeds and a synchronizing unit 50 is provided for generating a signal used for changing the calculation element. A selection signal TS for selecting whether the harmonic should be produced according to the first example or the second example is applied to the synchronizing apparatus 50. A synchronizing signal SP for the entire electronic musical instrument is applied to the synchronizing unit 50. The synchronizing unit 50** produces, in response to these input signals, selection information Ty for selecting the first or second example, calculation element information OP and two harmonic selection information TH which instructs calculation in accordance with the formula (3).

A shift device 43 is provided for producing information NQR corresponding to the harmonic order $n$ (i.e. $n\,\omega_0 t$) at the calculation timing $BTC_1$. The order $n$ is 32 in the first example shown in the table and 64 in the second example. If the selection signal Ty selects the first example, the basic information QR is multiplied by 32 to obtain 32 × QR, whereas information 64 × AR is obtained if the signal Ty selects the second example. The multiplication of the basic information QR by 32 is effected simply by shifting the basic information QR by five bits towards more significant bits. The output of this shift device 43 is applied to a subtractor 45 through a selection gate 44 only at the first calculation timing $BTC_1$.

A shift device 42 is provided for producing information to be subtracted from the information $n\,\omega_0 t$ in the formula (3) or (6) in response to calculation element information OP. The information OP designates amount of shift of the basic information QR. If the information OP designates shifting by 1 bit towards less significant bits, information ½QR is obtained. If the information OP designates shifting by 1 bit towards more significant bits, information 2QR is obtained, and if the information OP designates shifting by 2 bits towards more significant bits, information 4 QR is obtained. At the first calculation timing $BTC_1$, the information QR is shifted by 1 bit towards less significant bits to produce the information ½QR. The output of the shift device 42 is supplied to the subtractor 45 as subtrahend. Accordingly, the subtractor 45 conducts subtraction (N − ½)QR at the calculation timing of $BTC_1$. N is the order of the first harmonic produced from the shift device 43 at the first calculation timing, e.g. 32 in the first example and 64 in the second example.

The output of the subtractor 45 is temporarily held in a register 46 and thereafter applied to the selection gate 44 and a complementor 47. The output of the complementor 47 is used as address for reading out amplitudes at respective sample points of a sine waveshape stored in a logarithemic form in a sine waveshape memory 48. Information corresponding to the sine wave function term of log sin $(n-\frac{1}{2})\,\omega_0 t$ in the formula (3) or (6) is read from the sine waveshape memory 48 (where $n = 32$ (the first example) at the calculation timing $BTC_1$. This information log sin $(n-\frac{1}{2})\,\omega_0 t$ is added to log cos $\omega_0 t$ + log cos $\frac{1}{2}\omega_0 t$ which is a result of addition in an adder 51 of the outputs from cosine wave content generators **4*b*, 4*c*** to be described later to produce the composite wave values of four harmonics log $Ym_4$ in the formula (6). Since log 4 in the formula (6) is a constant, this is not included in calculation. In the first example, the four harmonics calculated at the first calculation timing are the 30th – 33rd harmonics.

At calculation timing $BTC_2$ and subsequent calculation timings, information (N − ½) QR from the register 46 is selected in the selection gate 44 and thereafter is applied to the subtractor 45. N is a value which changes at each calculation timing. On the other hand, the shift amount in the shift device 42 changes at the calculation timing $BTC_2$ and subsequent timings and information 4QR is produced. Accordingly, the output of the subtractor 45 at the calculation timing $BTC_2$ becomes $(32-\frac{1}{2})QR - 4QR = (28-\frac{1}{2})QR$ in the first example. The order of harmonic at this calculation timing is $n = 28$ as shown in the table. Subtraction (reverse cumulative addition) is sequentially conducted in the same manner at the respective subsequent calculation timings. For example, the output of the subtractor 45 at the calculation timing $BTC_3$ is $(28-\frac{1}{2})QR - 4QR = (24-\frac{1}{2})QR$.

In the first example, two harmonics are simultaneously calculated at the calculation timing $BTC_5$ and subsequent calculation timings. The shift amount in the shift device 42 changes to produce information 2QR. Accordingly, the output of the subtractor 45 at the calculation timing $BTC_5$ is $(16=\frac{1}{2})QR - 2QR = (N-\frac{1}{2})QR$ and the order of harmonic $n$ is 14 as shown in the table. Since calculation is conducted in accordance with the formula (3) in the case of two harmonics, the cosine wave component generator **4*b* for obtaining log cos $\omega_0 t$ becomes unnecessary. For this reason, two harmonic selection signal TH is applied to a gate circuit 52 of the generator 4*b* to disenable this gate circuit 52 and thereby to prevent application of the basic information QR to the generator 4*b*. Accordingly, log cos $\omega_0 t$ is not produced but only log cos $\frac{1}{2}\omega_0 t$ is applied through an adder 51 to an adder 49. The adder 49** conducts addition according to the formula (3) to produce the composite amplitude information log $Ym_2$ of two harmonics. Log 2 in the formula (3) which is a constant is not included in the calculation.

The basic information QR applied to the cosine wave component generator **4*b* thereafter is applied to a complementor 53 through a gate circuit 52. The gate circuit 52 provides the complementor 53 with the basic information QR only during absence of the selection signal TH. That is, the generator 4*b* is not used in the calculation according to the formula (3) but used when the calculation according to the formula (6) is conducted. The basic information QR applied to the generator 4*b* is shifted by one bit towards less significant bits in a shift device 55 and the shifted information ½QR (corresponding to ½ $\omega_0 t$) is applied to a complementor 56. The outputs of the complementors 54, 57 are used as address for reading out amplitudes at respective sample points of cosine wave shapes stored in a logarithmic form in cosine waveshape memories 54, 57. Information corresponding to the cosine wave functions log cos $\omega_0 t$, log cos ½$\omega_0 t$ in the formula (3) or (6) is read from the memories 54, 57. No reverse accumulation at the calculation timing $BTC_1$ – $BTC_8$ is conducted in the generators 4***b*, 4*c* so that the information from the memories 54, 57 does not change during one channel time.

In order to reduce capacity, the sine waveshape memory 48 and the cosine waveshape memories 54, 57 are adapted to digitally store logarithmically expressed information of wave values at respective sample points of a quarter cycle of a waveshape. On the other hand, the cumulative addition in the basic information generator 40 is made unitl it has amounted to a phase of one cycle $2\pi$. Accordingly, distinction between a first half cycle (0) and a second half cycle (1) of a waveshape is made in accordance with contents (0 or 1) of the most significant bit of the basic information AQR or the output of the register 46. This information of the most significant bit is hereinafter referred to as sign signals $S_1$, $S_2$, $S_3$. Further, distinction between a first quarter cycle (0) and a second quarter cycle (1) can be made in accordance with contents (0 or 1) of a bit which is one bit less significant than the most significant bit. For this purpose, the signal of this bit which is one bit less significant than the most significant bit is applied to a control input of complementors, 47, 53, 56 and information of bits which are less significant than this bit signal is used as address for the memories 48, 54, 57 through complementors 47, 53, 56. More, specifically, a waveshape for the first quarter cycle is read out in accordance with the accumulated information and a waveshape for the next quarter cycle is read out by obtaining complements of the accumulated information and reversely reading out the wave values of the first quarter cycle. The sine and cosine wave value information can be substantially obtained in the foregoing manner. Actually, the amplitudes corresponding to the former half cycle of the waveshape are repeatedly read out and the sign is inverted in the second half cycle in a harmonic coefficient multiplicator 5 to be described later in accordance with the sign signals $S_1$, $S_2$, $S_3$ for producing a normal waveshape. That is, the sign signals $S_1$, $S_2$, $S_3$ are synthesized in exclusive OR circuits $EQR_1$, $EQR_2$ and a synthesized signal S is provided to the harmonic coefficient multiplicator 5.

In FIG. 1, an envelope information generator 6 generates in a time sharing manner envelope control information including attack, decay sustain and release by each of the tones to be produced simultaneously, (i.e. every channel time) in response to the key-on and key-off information from the key assigner 2. This envelope control information may conveniently be expressed in a logarithmic form.

A tone color memory 8 previously stores amplitude coefficients (level information) of the respective harmonic components realizing various tone colors and provides, in response to the harmonic order signal BTC, amplitude coefficient (level) information of harmonic components corresponding to a tone color selected by operation of a tone color selection switch 7 in time shared sequence by each of the harmonics. This level information of the harmonic content should preferably be an average value of levels of the respective harmonics. Since, however, the levels of the respective harmonics are close to each other, a level of one harmonic may representably be picked up as level information for a particular group of harmonics. A harmonic control unit 9 performs control function including modulation of the read out coefficient information of the respective harmonics and selection of the coefficient information for obtaining different tone colors according to the kind of keyboard, supplying in time sharing the coefficient information of the respective harmonics (including a fundamental wave) to the multiplicator 5. This amplitude coefficient information also may conveniently be expressed in a logarithmic form.

In the harmonic coefficient multiplicator 5, the envelope control information for controlling the entire level of a certain tone and amplitude coefficient information of the harmonics of the respective degrees for realizing a desired tone color is multiplied with composite waveshape information of the harmonics of a particular group supplied from the harmonic generator 4, i.e. log sin $(n - ½)\ \omega_0 t$ + log cos $\omega_0 t$ + log cos ½ $\omega_0 t$. If the respective information is expressed in a logarithmic form, the multiplication is substituted by addition. Thus, waveshape amplitude information characterized in its tone color and envelope is produced in time sharing for each harmonic content. The logarithmically expressed information is converted to linear information in the multiplicator 5 having such converter portion. Further, since the information of the half cycle waveshape is not inverted yet, the amplitude information which has now been converted to linear information is inverted in response to the sign signal S to form perfect waveshape information.

The waveshape information of the respective harmonics produced in this manner is applied to an accumulator 10. The accumulator 10 adds together composite waveshape values of the respective harmonic groups corresponding to the calculation timings $BTC_1$–$BTC_8$ by each tone (i.e. at each channel time) to produce a single musical tone waveshape consisting of multiple harmonic components (24 harmonics in the first example and 32 harmonics in the second example). If desired, amplitudes of the respective tones may be added together by the kind of keyboard. The musical tone waveshape information of the composite harmonic contents is applied to a digital-analog converter 11 where it is converted to an analog waveshape signal and thereafter is sounded through an accoustic system 12.

Since the first harmonic (i.e., fundamental wave) information to the eighth harmonic information is particularly important for determining a tone color, a harmonic oscillator (not shown) may be separately provided to individually produce harmonic waveshape information. In this case, the information is added to composite waveshape of the ninth to 33rd harmonics in the accumulator 10. If one desires to have a musical tone contain harmonic contents up to the 65th harmonics, composite waveshape amplitudes of the 34th – sixth harmonics may be further added in the accumulator 10. In this case, two harmonic generators 4 are provided in parallel and a first to eighth harmonic oscillator is further provided in parallel. Accordingly, calculation is sequentially conducted eight times by these three calculation units to produce the first to 65th harmonic contents. If the same number of harmonic contents are to be obtained within the same period of time by the prior art device, 8 calculation units (harmonic generators) must be provided in parallel. It will be apparent from this comparison that according to the invention, a large number of harmonic components can be produced with a relatively small number of calculation units (generators).

In the foregoing embodiment, description has been made on the assumption that the number of harmonics to be calculated simultaneously is 2 or 4. The invention however is not limited to this but any number of harmonics can be calculated if these harmonics are close in their level to each other in the harmonic component spectrum. Construction in such a case is very similar to the above described embodiment and will be obvious to those skilled in the art. The shift devices 42, 55 which substantially perform a function of a multiplicator may not be utilized as a multiplicator depending upon the nunber of harmonics to be calculated at a time. In this case, a multiplicator must be used. Further, the accumulation in the harmonic calculator 4*a* is made from a harmonic of a higher order. The manner of accumulation is not limited to this but it may be made from a harmonic of a lower order, though the reverse accumulation is more convenient in the present embodiment because the simplest construction is achieved by such reverse accumulation

What is claimed is:

1. An electronic musical instrument of a type wherein wave values at successive sample points of a musical tone waveshape are calculated by sequentially calculating wave values of respective harmonic components at each of the sample points with a regular time interval and cumulatively adding the wave values of the respective harmonic components comprising:

a harmonic calculator for sequentially calculating, with said regular time interval, a sine wave component including a harmonic order of a composite wave of a group of harmonics represented by a single multiplication term of a sine wave component including the harmonic order and a cosine wave component not including the harmonic order of each harmonic group;

a cosine wave component calculator for calculating said cosine wave component not including the harmonic order of said composite wave in accordance with phase angle information of the fundamental wave; and means for sequentially synthesizing information of said respective components provided from said harmonic calculator and said cosine wave components calculator;

composite wave values of respective groups of harmonics being sequentially produced with said regular time interval and said composite wave values being cumulatively added for producing musical tone waveshape of all the harmonic components included in the respective groups of harmonics.

2. An electronic musical instrument as defined in claim 1 wherein said harmonic calculator calculates log sin $(n - \frac{1}{2})\ \omega_0 t$ (where $n$ represents the harmonic order, $\omega_0$ angular velocity of the fundamental wave) and said cosine wave component calculator calculates log cos $\frac{1}{2}\ \omega_0 t$.

3. An electronic musical instrument as defined in claim 2 wherein said cosine wave component calculator comprises a calculation circuit which calculates log cos $\omega_0 t$ and an adder which adds said log cos $\frac{1}{2}\omega_0 t$ and said log cos $\omega_0 t$ together.

4. An electronic musical instrument as defined in claim 2 wherein said harmonic calculator comprises:

a first shift device which receives information QR corresponding to the phase angle $\omega_0 t$ (where R represents frequency information and $Q = 1, 2, 3 \ldots$ )and produces information ½QR at the first calculation timing and information K × QR (where K represents the number of harmonics to be obtained simultaneously) at subsequent calculation timings;

a second shift device which receives information QR and produces information $n \times$ QR (where $n$ represents a harmonic order) at the first calculation timing;

a selection gate unit which selects the output of said second shift device at the first calculation timing and selects the output of a register at the other calculation timing;

a subtractor which subtracts the output of said first shift device from the output of said selection gate unit;

wherein the said register temporarily holds the output of said subtractor; and a sine waveshape memory which is addressed by the output of said register to provide a sine wave value at a sample point corresponding to the output of said register;

and wherein said cosine wave component calculator comprises;

a shift device which shifts the information QR to produce information ½QR; and a cosine waveshape memory which is addressed by the output of said shift device to provide a cosine wave value at a sample point corresponding to the output of said shift device.

5. An electronic musical instrument as defined in claim 3 wherein said calculation circuit comprises a cosine waveshape memory which is addressed by the information QR to provide a cosine waveshape amplitude at a sample point corresponding to the information QR.

* * * * *